US005413258A

United States Patent [19]

Kartler

[11] Patent Number: 5,413,258

[45] Date of Patent: May 9, 1995

[54] WIPING DEVICE FOR CAULKING

[75] Inventor: David Kartler, Las Vegas, Nev.

[73] Assignees: Thomas P. Mahoney; J. Mark Holland, both of Newport Beach, Calif.

[21] Appl. No.: 118,134

[22] Filed: Sep. 8, 1993

[51] Int. Cl.[6] ..... B28B 3/00

[52] U.S. Cl. ..... 222/575; 425/87; 425/458; 401/266

[58] Field of Search ..... 222/527, 566–568; 401/266, 48, 193, 261–264; 425/87, 458, 12, 96

[56] References Cited

U.S. PATENT DOCUMENTS

| | | | |
|---|---|---|---|
| 721,168 | 2/1903 | Egert | 425/458 |
| 845,530 | 2/1907 | Davis | 425/87 |
| 1,085,566 | 1/1914 | Glover | 425/458 X |
| 1,126,253 | 1/1915 | Morris | 425/458 X |
| 1,661,599 | 3/1928 | Cynova | 425/458 X |
| 2,102,749 | 12/1937 | Salvesen | 401/264 |
| 2,377,837 | 6/1945 | Zimmermann | 401/266 X |
| 2,559,553 | 7/1951 | Wolff | 401/266 X |
| 2,636,214 | 4/1953 | Slusher | 425/87 X |
| 2,903,739 | 9/1959 | Hann | 425/87 |
| 2,930,063 | 3/1960 | Stull | 401/266 X |
| 2,943,338 | 7/1960 | Lowen | 425/87 |
| 3,332,108 | 7/1967 | Bustamante | 425/87 |
| 3,363,279 | 1/1968 | Bright, Jr. | 401/261 X |
| 3,963,357 | 6/1976 | Crisp | 401/266 X |
| 4,516,868 | 5/1985 | Molnar | 425/87 X |
| 4,570,834 | 2/1986 | Ward | 222/575 X |
| 5,017,113 | 5/1991 | Heaton et al. | 401/266 X |
| 5,244,388 | 9/1993 | Frush | 222/575 X |
| 5,250,145 | 10/1993 | Despins | 401/261 X |
| 5,277,511 | 1/1994 | Stockton | 425/87 X |

*Primary Examiner*—Andres Kashnikow
*Assistant Examiner*—Kenneth DeRosa
*Attorney, Agent, or Firm*—J. Mark Holland; Thomas P. Mahoney

[57] ABSTRACT

A wiping device for caulking which can be applied for use in conjunction with a caulking gun, mounted on a caulking gun or mounted on a caulking tube and which wipes and smooths the surface of the caulking immediately after it is deposited from the nozzle of the caulking tube.

16 Claims, 2 Drawing Sheets

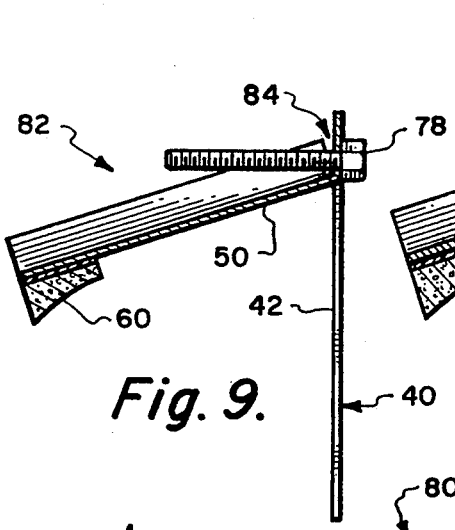
Fig. 9.
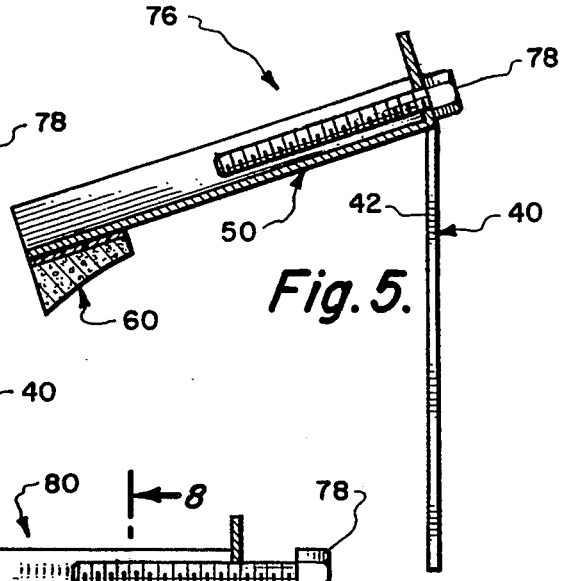
Fig. 5.
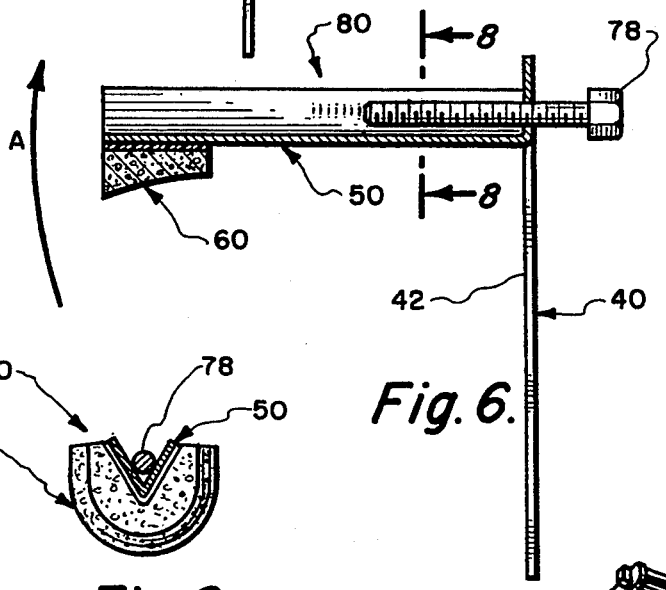
Fig. 6.
Fig. 8.
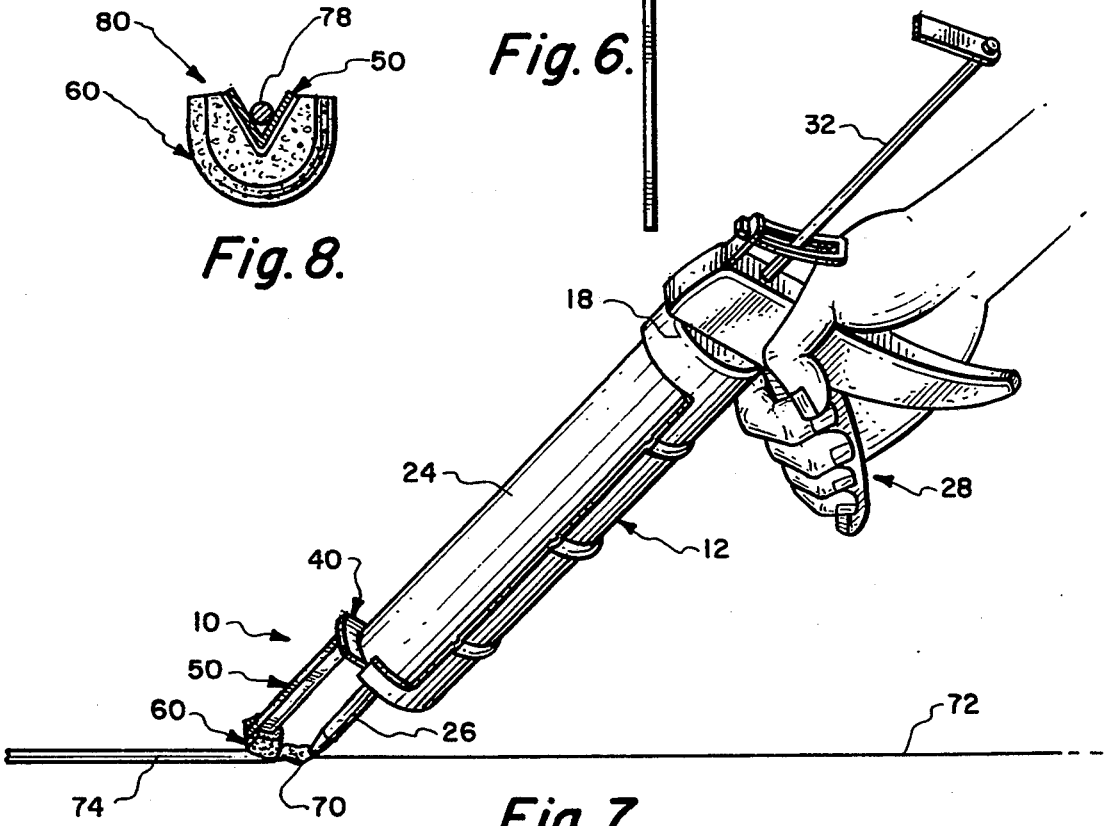
Fig. 7.

WIPING DEVICE FOR CAULKING

This invention relates to a wiping device for caulking and, more particularly, to a wiping device which is usable in conjunction with a conventional caulking gun so that the caulking deposited by said caulking gun can be immediately wiped to eliminate irregularity in the caulking immediately after the deposition thereof.

BACKGROUND OF THE INVENTION

It is well known to those skilled in the art that caulking is necessary to seal gaps which exist between adjacent structural members in a wide variety of applications. Typical of such applications are the corner defined between adjacent edges of drywall panels where it is necessary to seal the gap between said edges to provide an attractive surface which will receive paint or other wall coating subsequently deposited thereupon. In addition, caulking is widely utilized in various types of fenestration such as curtain wall and window wall where the caulking is deposited between adjacent structural members to insure the weather-proofing of gaps which exist therebetween.

Caulking guns are the conventional expedient utilized to apply caulking and are designed to receive tubes of caulking which have elongated applicator nozzles associated therewith. Such caulking guns include a semi-circular receptacle having spaced end plates which define a receptacle space equivalent to the length and diameter of the tubular caulking receptacle. The rear end plate of such caulking guns includes a plunger which is adapted to displace a rear end cap on the tube and force the caulking through the applicator nozzle.

The forward end plate of the caulking gun is provided with an aperture which permits the applicator nozzle to protrude from the forward extremity of the caulking gun. A trigger-like actuator is associated with the plunger and is manipulated by the mechanic applying the caulking to cause the caulking to be expressed from the end of the applicator nozzle.

In applying the caulking, the applicator nozzle is placed adjacent the gap to be sealed and the nozzle is drawn over the gap from the top to the bottom thereof or from one side to the other thereof, the mechanic attempting to expel caulking through the nozzle at a rate commensurate with the speed of movement of the caulking gun along the gap.

However, caulking, as it is applied, has a tendency to assume an uneven configuration which has a rippling or puddling aspect.

The caulking must be smooth to eliminate the unevenness thereof and the prevalent method of eliminating the unevenness of the caulking is for the mechanic to run his finger over the surface of the caulking to achieve the desired smoothing thereof.

Frequently, mechanics utilize quick-setting glue on their fingers to provide a surface which will assist in smoothing the caulking.

A caulking finisher is disclosed in U.S. Pat. No. 3,744,079 and has a forward extremity which is pushed against the surface of the caulking to smooth the same. However, the utilization thereof requires the mechanic to return to the caulking site after the application process has been completed and to smooth the caulking in a subsequent operation.

OBJECTS AND ADVANTAGES OF THE INVENTION

An object of the invention is the provision of a device for smoothing caulking which accomplishes the smoothing of the caulking simultaneously with the application thereof, thus eliminating the necessity for a separate smoothing operation and, also, achieving a more effective smoothing operation because of the fact that the caulking is in a state of maximum fluidity because of the recency of the deposition thereof.

Another object of my invention is the provision of a device which is particularly adapted for utilization with conventional caulking guns reducing to a minimum the expenditure involved in providing the device.

A further object of the invention is the provision of a caulking wiper which is cooperative with a caulking gun and which is provided with mounting means adapted to permit the installation thereof on the caulking gun with a minimum of expenditure of effort.

Another object of the invention is the provision of a wiping device for caulking which includes a mounting means constituted by a mounting plate, said mounting plate being disposable between the forward wall of the caulking gun and the forward extremity of the caulking tube so that the mounting plate is firmly retained in operative relationship with the caulking gun and with no further means of attachment to the caulking gun.

An additional object of the invention is the provision of a wiping device for caulking which includes a wiper arm extending outwardly from the aforesaid mounting plate and which is spaced a minimal distance from the outlet of the applicator nozzle of the caulking tube.

Another object of the invention is the provision, in a device of the aforementioned character, of a wiping head on the outer extremity of the wiper arm which is engagable with the uneven surface of the recently deposited caulking and which provides an automatic smoothing action as the caulking is deposited by said nozzle.

Another object of the invention is the provision of a variety of wiping heads including synthetic sponge, rubber tips or the like. The sponge usage is advantageous because it can be soaked in water which greatly facilitates the smoothing process.

Other objects and advantages of the invention will be apparent from the following specification and the accompanying drawings.

BRIEF DESCRIPTION OF THE DRAWINGS

FIG. 5 is a vertical sectional view of an alternative embodiment of the invention, showing an acute angle between the wiping arm 50 and the mounting plate 42, and illustrating adjustment means 78 for adjusting the flexing of the wiping arm;

FIG. 6 is a view similar to FIG. 5 of yet another embodiment, showing a non-acute angle and another adjustment of adjustment means 78;

FIG. 7 is a view showing the application of caulking and the smoothing thereof by the device of the invention;

FIG. 8 is a sectional view, taken along lines 8—8 of FIG. 6; and

FIG. 9 is a view similar to FIG. 5, but showing another alternative embodiment of the invention.

PREFERRED EMBODIMENTS OF THE INVENTION

Figure 1:
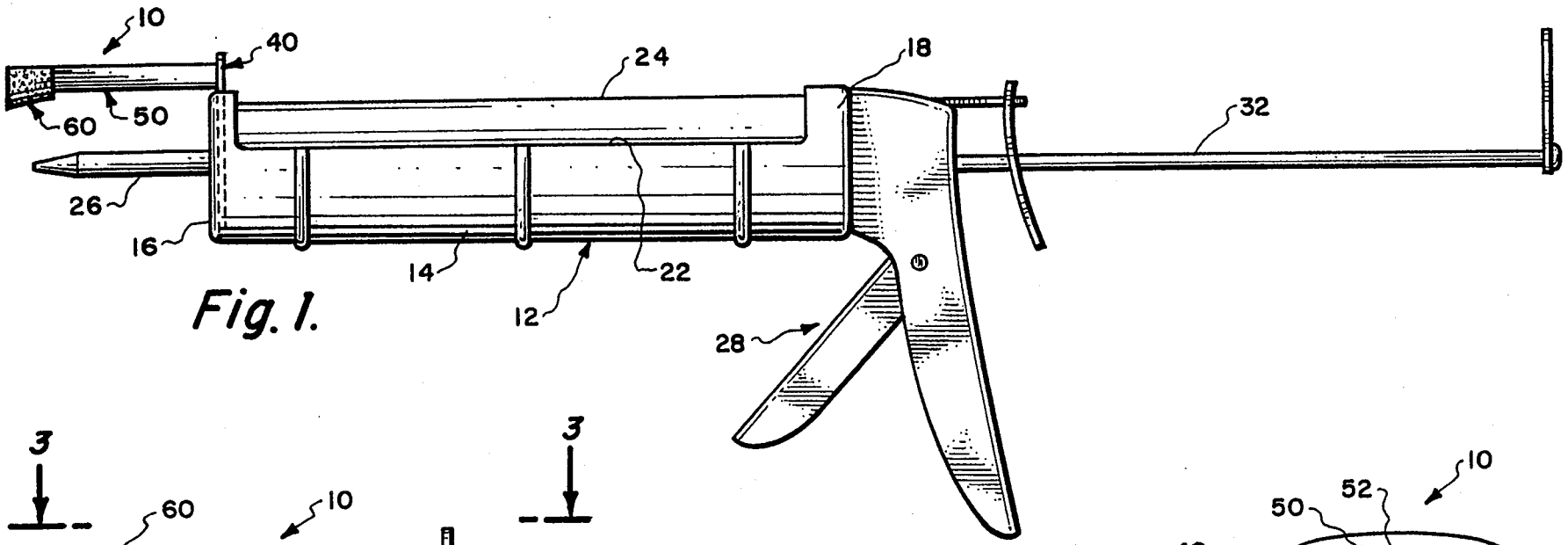
FIG. 1 is a side elevational view showing the wiping device mounted in a conventional caulking gun.
Figure 2:
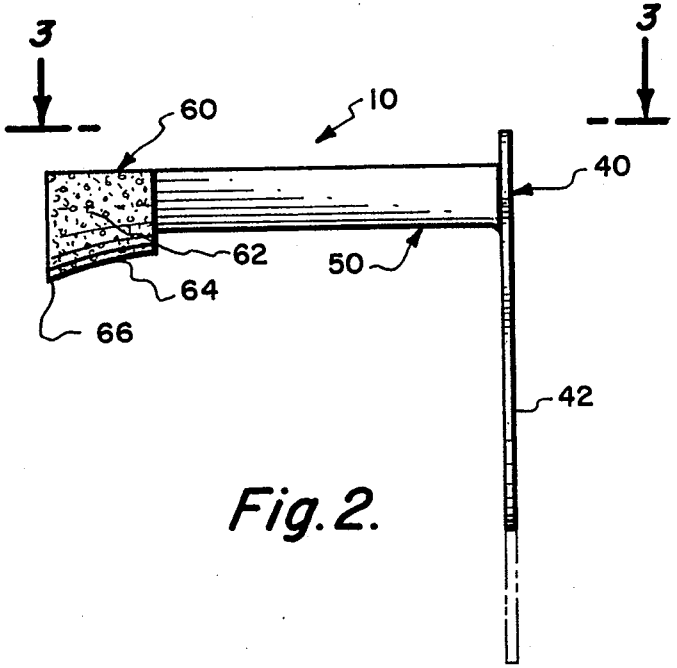
FIG. 2 is a side elevational view of the wiping device.

Referring to the drawings, and particularly to FIGS. 1–4 thereof, I show a wiping device 10 constructed in accordance with the teachings of the invention mounted in operative relationship with a caulking gun 12. As described below, the invention includes the device 10 as well as its combination with a caulking gun and/or a tube of caulking compound.

The caulking gun 12 is of conventional configuration and includes an elongated semi-cylindrical body 14 having a front end plate 16 and a rear end plate 18. The body provides a receptacle 22 for a cylindrical tube 24 of caulking, said tube having an applicator nozzle 26 at its forward extremity which protrudes through a corresponding opening (not shown) in the front wall 16 of the caulking gun 12.

Mounted on the rear wall 18 of the caulking gun is a trigger device shown generally at 28 which is intended to advance a rod 32 connected to a plunger, not shown, which deflects the rear wall of the tube 24 to expel caulking through the applicator nozzle 26.

The wiping device 10 includes mounting means 40 for mounting the device on the gun 12. In the preferred embodiment of the invention, the mounting means 40 includes a mounting plate 42 which preferably incorporates an elongated opening 44 to provide a bifurcated configuration to the mounting plate 42. Due to this bifurcated configuration, the opening 44 may "straddle" the dispensing nozzle of the caulking tube, as illustrated in the drawings.

The preferred embodiment of the wiping device 10, it is contemplated, can be readily manufactured from a metal blank in a metal stamping process. In that situation, a wiping arm 50 can be provided by the formation of the opening 44 during the metal stamping process.

To form the mounting arm 50, the metal which is cut from the blank to provide the opening 44 remains secured at its upper extremity to the upper extremity of the opening 44 and is bent upwardly into a preferably substantially right-angular relationship with the mounting plate 42. To position the outer extremity of the arm 50 more closely to the point of dispense of the caulking compound, there can be a slight downward angular relationship of the wiping arm 50 with the mounting plate 42 (see FIG. 5, for example), to provide an acute angle between the wiping arm 50 and the mounting plate 42.

Figure 3:
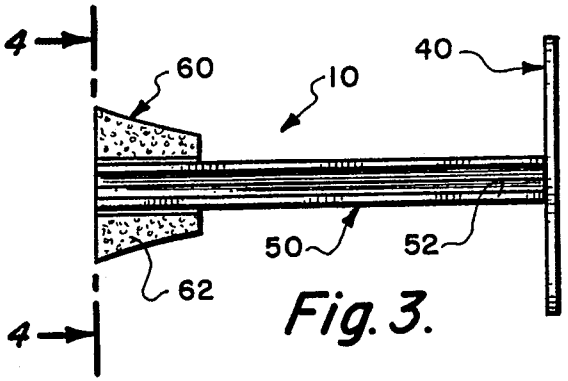
FIG. 3 is a top plan view taken from the broken line 3—3 of FIG. 2.
Figure 4:
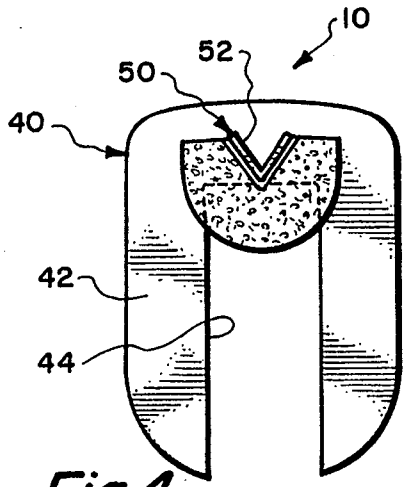
FIG. 4 is a front elevational view taken from the broken line 4—4 of FIG. 3.

To impart rigidity to the wiping arm 50, it is preferably stamped into a V-shaped configuration which establishes a channel 52, as best shown in FIGS. 3 and 4 of the drawings.

In the preferred embodiment, the outer extremity of the wiping arm 50 includes wiping means 60 for wiping the caulking compound after it has been deposited (as described elsewhere herein). In the embodiment of FIGS. 1–4, the wiping means 60 is illustrated as a wiping head constituted by a pad 62 of cellulose sponge or other hygroscopic material operably affixed to the arm 50 by glue, tackweld, or similar expedient. The pad 62 is preferably essentially semi-circular in configuration but has a tapered profile 64 to impart a relatively sharply defined leading edge 66 to the forward extremity of the pad 62 where it engages the caulking, in a manner to be described in greater detail below.

The pad 62 may be releasably assembled to the arm 50 by clips or similar expedient to permit the replacement of the pad 62 either during the course of a particular application or at such time as the pad 62 wears out. This effectively "extends the life" of the arm 50 and the plate 42 when the pad 62 wears out. Moreover, this interchangeability permits pads 62 of various configurations to be utilized with a single arm 50.

The utilization of the wiping device 10 in smoothing recently-deposited caulking 70 is illustrated in FIG. 7 of the drawings wherein the associated caulking gun and dispensing nozzle 26 are shown as being drawn across a gap 72. As the caulking 70 issues from the dispensing nozzle 26, the surface of the caulking 70 is relatively irregular.

However, wiping means 60 can be drawn across the rough surface of the previously-deposited caulking during and as part of the same motion used to deposit the caulking 70. The wiping means 60 thereby imparts a smooth surface 74 to the caulking simultaneously with the deposition of the caulking 70, thus eliminating the necessity for the mechanic to return in a subsequent operation of smoothing the caulking 70.

If a sponge is utilized as the wiping means 60, it is helpful to wet the sponge prior to use. The dampened material tends to accomplish the desired smoothing action better than a dry sponge.

In addition to smoothing the dispensed caulking compound, the wiping means 60 functions to remove some or even all of certain excess caulking compound that may be inadvertently dispensed during application or operation of the caulking gun 12.

The device 10 can be fabricated from materials other than sheet metal. By way of example but not by way of limitation, it can be fabricated from synthetic and plastic by injection molding and can be fabricated from various metals such as steel, aluminum or the like.

In fabricating the preferred embodiment of the device 10 from a sheet metal blank, it is necessary to provide sufficient length in the blank to accommodate the length of the wiping arm 50. This might cause the blank or the resultant mounting plate to be longer than desired for installation in the forward extremity of the caulking gun 12. To avoid such excessive length, it can be sheared off (as shown in phantom lines in FIG. 2) after the arm 50 has been oriented into its preferably slightly inclined relationship with the mounting plate 42.

Alternative embodiment 76, 80, and 82 of the wiping device are illustrated in FIGS. 5, 6, 8 and 9 of the drawings wherein the various components of the device are essentially similar to those of the aforedescribed wiping device 10.

Pressure exerted upon the wiping arm during the wiping process can cause a slight deflection or deformation (not shown) of the mounting means 40, such as by bending the wiping arm 50 in the direction indicated by arrow A on FIG. 6.

In order to adjust and/or limit the amount of any such deflection of the wiping arm 50, a self-threading bolt 78 is threaded through a corresponding opening in the mounting plate 42 and the shank of the bolt either engages the V-shaped wiping arm 50, as shown in FIG. 8, or is positioned to limit the deflection of the arm 50 in direction A, as shown in FIG. 9. As shown in FIGS. 5 and 6 of the drawings, the bolt can be threaded through the corresponding orifice in the mounting plate 42 to any of a wide range of positions, to thereby adjust and/or limit the amount of deflection of the wiping arm 50 in direction A. As the bolt 78 is withdrawn from the wiping arm 50 (see FIG. 6 as compared to FIG. 5), less contact and support occurs between the bolt 78 and the arm 50, thereby permitting correspondingly relatively greater deflection of the arm 50 in direction A due to the aforesaid pressure on the wiping means 60.

In the embodiment of FIG. 9, the bolt 78 is relatively spaced from the arm 50 (in comparison to the embodiments shown in FIGS. 5, 6 and 8. This spacing can permit an even greater (and sometimes desirable) degree of flexure of the arm 50 relative to the plate 42.

For example, this flexure (as well as the flexure provided by embodiments such as those of FIGS. 5, 6 and 8) is especially useful when the application surface is "rough" (such as a stucco surface). When applying caulk or other caulk-like materials to such surfaces, the wiping device will function better if the arm 50 and wiping means 60 can "ride" up and down to some degree over the roughness. If the arm 50 is too stiff (that is, if it did not include some desirable degree of flexibility), the "high points" of such rough surfaces may be wiped too forcefully, sometimes so forcefully as to remove more of the caulk than is desirable.

Also in the embodiment of FIG. 9, although the V-shaped gap 84 exists between the arm 50 and the mounting plate 42 due to the preferred stamping of the device 40 from a single plate, other embodiments could be readily manufactured without such a gap 84. For example, the arm 50 could be formed from a separate piece of material, and the end of the arm 50 adjacent the former gap 84 could be angled appropriately to mate against the plate 42 without any gap 84. Even if the arm 50 and plate 42 are stamped from the same piece of material, the gap 84 could be subsequently "filled in" with other material, such as by welding, gluing or the like.

Thus, by my invention, I provide a wiping device for caulking which eliminates the tedious and expensive processes presently utilized in smoothing caulking after its application has been completed. Because of the high production expected of mechanics, any additional time expended in improving on an initial application can be costly, especially in a cumulative sense.

Therefore, considerable economies in expenditure of time and a more effective smoothing of the caulking immediately after its application are achieved by the wiping device of the invention. The wiping device can be manufactured as a separate component which can be repeatedly installed in a caulking gun as the contents of the caulking tube are exhausted. The wiping device can also be mounted in operative relationship with a caulking gun as a component of the caulking gun and a mounting means for the wiping device can be secured to the forward wall of the caulking gun by welding or other expedients.

Alternatively, the wiping device can be provided as a component of the caulking tube 24 and the mounting means provided by strengthening the forward wall of the caulking tube which will then serve as mounting means for the wiping arm.

Although I have described specific embodiments of the invention, it will be obvious to those skilled in the art that various details thereof may be altered without departing from the scope of the appended claims.

I claim:

1. In a wiping device for use with a caulking applicator having a caulking outlet, the combination of: mounting means for positioning said device on said caulking applicator adjacent said outlet but spaced therefrom; an arm secured to said mounting means at a location spaced from said outlet; and wiping means located on the outer extremity of said arm, said arm and said wiping means being configured to permit the application and smoothing of caulk in a corner joint of an adjacent surface, in which said wiping means is hygroscopic.

2. In a wiping device for use in conjunction with a caulking applicator having a caulking depositing nozzle, the combination of: mounting means for locating said device on said caulking applicator adjacent said nozzle; an elongated wiping arm extending outwardly from said mounting means, said arm being spaced from said nozzles and a wiping head mounted on the outer extremity of said wiping arm for wiping caulking as it issues from said nozzle, said arm and said wiping head being configured to permit the application and smoothing of caulk in a corner joint of an adjacent surface, in which said arm is deflectable on said mounting means and in which adjustment means is provided between said mounting means and said arm to control the deflection of said arm when pressure is applied to said wiping head.

3. In a wiping device for use in conjunction with a caulking applicator having a caulking depositing nozzle, the combination of: mounting means for locating said device on said caulking applicator adjacent said nozzle; an elongated wiping arm extending outwardly from said mounting means, said arm being spaced from said nozzle; and a wiping head mounted on the outer extremity of said wiping arm for wiping caulking as it issues from said nozzle, said arm and said wiping head being configured to permit the application and smoothing of caulk in a corner joint of an adjacent surface, in which said wiping head is hygroscopic.

4. In a caulking wiper for wiping caulking immediately after the application of said caulking by a caulking applicator, the combination of: a mounting plate for locating said caulking wiper on said caulking applicator; a wiping arm attached to said mounting plate at a location spaced from the point of application of said caulking and extending outwardly from said mounting plate; and a wiping head mounted on the extremity of said wiping arm, said arm and said wiping means being configured to permit the application and smoothing of caulk in a corner joint of an adjacent surface, in which said wiping arm is deflectable with respect to said mounting plate and in which adjustment means is provided between said mounting plate and said wiping arm to adjust the extent of deflection of said wiping arm with respect to said mounting plate.

5. The caulking wiper of claim 4 in which said mounting arm is disposed at an acute angle with respect to said mounting plate.

6. In a caulking wiper for wiping caulking immediately after the application of said caulking by a caulking applicator, the combination of: a mounting plate for locating said caulking wiper on said caulking applicator; a wiping arm attached to said mounting plate at a location spaced from the point of application of said caulking and extending outwardly from said mounting plate; and a wiping head mounted on the extremity of said wiping arm, said arm and said wiping means being configured to permit the application and smoothing of caulk in a corner joint of an adjacent surface, in which said wiping head is compressible.

7. In a caulking wiper for wiping caulking immediately after the application of said caulking by a caulking applicator, the combination of: a mounting plate for locating said caulking wiper on said caulking applicator; a wiping arm attached to said mounting plate at a location spaced from the point of application of said caulking and extending outwardly from said mounting plate; and a wiping head mounted on the extremity of said wiping arm, said arm and said wiping means being configured to permit the application and smoothing of caulk in a corner joint of an adjacent surface, in which said wiping head is hygroscopic.

8. In a caulking wiper for use in conjunction with a caulking gun having a caulking applicator nozzle, the combination of: a mounting plate engagable with said caulking gun; a wiper arm extending outwardly from said mounting plate adjacent said applicator nozzle and substantially co-terminus therewith; and a wiper head on the outer extremity of said arm to wipe said caulking immediately after application thereof by said caulking gun, said arm and said wiper head being configured to permit the application and smoothing of caulk in a corner joint of an adjacent surface, in which said wiper arm is deflectable on said mounting plate and in which adjustment means is provided between said mounting plate and said wiper arm to adjust the deflection of said wiper arm.

9. The caulking wiper of claim 8 in which said mounting plate incorporates an opening for the reception of said applicator nozzle.

10. In a caulking wiper for use in conjunction with a caulking gun having a caulking applicator nozzle, the combination of: a mounting plate engagable with said caulking gun; a wiper arm extending outwardly from said mounting plate adjacent said applicator nozzle and substantially co-terminus therewith; and a wiper head on the outer extremity of said arm to wipe said caulking immediately after application thereof by said caulking gun, said arm and said wiper head being configured to permit the application and smoothing of caulk in a corner joint of an adjacent surface, in which said wiper head is compressible.

11. In a caulking wiper for use in conjunction with a caulking gun having a caulking applicator nozzle, the combination of: a mounting plate engagable with said caulking gun; a wiper arm extending outwardly from said mounting plate adjacent said applicator nozzle and substantially co-terminus therewith; and a wiper head on the outer extremity of said arm to wipe said caulking immediately after application thereof by said caulking gun, said arm and said wiper head being configured to permit the application and smoothing of caulk in a corner joint of an adjacent surface, in which said wiper head is hygroscopic.

12. An apparatus for dispensing and wiping caulking compound, including: gun means having a body portion capable of receiving a tube of caulking compound and having means for causing the dispense of said compound; and wiping means operatively associated with said gun means, for wiping said compound contemporaneously as it is dispensed, in which said wiping means is hygroscopic.

13. The apparatus of claim 12, in which said wiping means is affixed to said gun means.

14. The apparatus of claim 13, in which said affixation of said wiping means to said gun means is accomplished by an arm secured to said gun means and said wiping means is affixed to an outer extremity of said arm.

15. The apparatus of claim 12, in which said wiping means is affixed to said tube of caulking compound.

16. The apparatus of claim 15, in which said affixation of said wiping means to said tube is accomplished by an arm secured to said tube and said wiping means is affixed to an outer extremity of said arm.

* * * * *